US011535469B2

(12) United States Patent
Ozawa et al.

(10) Patent No.: US 11,535,469 B2
(45) Date of Patent: Dec. 27, 2022

(54) SHEET FEEDING APPARATUS

(71) Applicants: Masatoshi Ozawa, Yamanashi-ken (JP); Hiroto Akiyama, Yamanashi-ken (JP); Seiji Nishizawa, Yamanashi-ken (JP); Kei Horiuchi, Yamanashi-ken (JP)

(72) Inventors: Masatoshi Ozawa, Yamanashi-ken (JP); Hiroto Akiyama, Yamanashi-ken (JP); Seiji Nishizawa, Yamanashi-ken (JP); Kei Horiuchi, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 17/133,952

(22) Filed: Dec. 24, 2020

(65) Prior Publication Data

US 2021/0198061 A1 Jul. 1, 2021

(30) Foreign Application Priority Data

| | | |
|---|---|---|
| Dec. 27, 2019 | (JP) | JP2019-239938 |
| Dec. 27, 2019 | (JP) | JP2019-239939 |
| Jun. 29, 2020 | (JP) | JP2020-111857 |
| Jun. 29, 2020 | (JP) | JP2020-111858 |

(51) Int. Cl.
*B65H 3/06* (2006.01)
*B65H 7/18* (2006.01)

(52) U.S. Cl.
CPC ..... *B65H 3/0684* (2013.01); *B65H 7/18* (2013.01)

(58) Field of Classification Search
CPC ..... B65H 3/0684; B65H 3/06; B65H 7/18; B65H 1/266
See application file for complete search history.

(56) References Cited

U.S. PATENT DOCUMENTS

| | | | | |
|---|---|---|---|---|
| 6,695,303 | B2 | 2/2004 | Okada et al. | |
| 7,422,205 | B2 | 9/2008 | Akiyama et al. | |
| 7,472,904 | B2 * | 1/2009 | Park | B65H 3/0684 271/117 |
| 7,677,556 | B2 * | 3/2010 | Murayama | B65H 3/06 271/162 |
| 2012/0074636 | A1 * | 3/2012 | Choi | B65H 1/04 271/3.18 |
| 2015/0309460 | A1 * | 10/2015 | Yamamoto | B65H 5/38 271/3.19 |

FOREIGN PATENT DOCUMENTS

| | | | |
|---|---|---|---|
| JP | 2000-203728 | A | 7/2000 |
| JP | 2001-139165 | A | 5/2001 |
| JP | 2002-274675 | A | 9/2002 |
| JP | 2005-303610 | A | 10/2005 |
| JP | 2010-100349 | A | 5/2010 |
| JP | 2015-221707 | A | 12/2015 |

* cited by examiner

*Primary Examiner* — Thomas A Morrison
(74) *Attorney, Agent, or Firm* — Manabu Kanesaka

(57) ABSTRACT

A sheet feeding apparatus includes: a storage part that stores a sheet, and a feeding part that has a feeding roller for feeding the sheet. The storage part and the feeding part are configured to be integrally inserted/withdrawn into/from an apparatus enclosure. The feeding roller is moved from a feeding position to a retracting position before the storage part and the feeding part are withdrawn from the enclosure.

6 Claims, 16 Drawing Sheets

SHEET FEEDING APPARATUS

BACKGROUND OF THE INVENTION

Field of the Invention

The present invention relates to a sheet feeding apparatus provided with a feeding roller for feeding a sheet.

Description of the Related Art

As a sheet feeding apparatus that feeds a sheet, JP 2002-274675A discloses a configuration in which a delivery roller for feeding a sheet is mounted to a storage case for storing the sheet so as to be withdrawable from an enclosure together with the storage case. In the sheet feeding apparatus disclosed in JP 2002-274675A, to store sheets in the storage case, the delivery roller is manually moved from a feeding position for feeding a sheet to a retracting position retracting from the sheet by a distance larger than the feeding position.

In the configuration in which the delivery roller as a feeding means is manually moved to the retracting position for sheet storage, a user may unintentionally touch the delivery roller at this time. This may cause dirt and oil to adhere to the delivery roller, which may lead to a reduction in friction coefficient of the roller to cause a sheet feeding failure. Further, in this configuration, components of a unit including the delivery roller may be broken at the manual operation.

SUMMARY OF THE INVENTION

A sheet feeding apparatus according to the present invention includes: a storage part that stores a sheet; a feeding part that has a feeding roller for feeding the sheet stored in the storage part; an enclosure into and from which the storage part and feeding part are integrally inserted and withdrawn; and a moving mechanism that moves the feeding roller of the feeding part to a feeding position for feeding the sheet and a retracting position for storing the sheet in the storage part. The moving mechanism moves the feeding roller to the retracting position before the storage part and the feeding part are withdrawn from the enclosure.

DESCRIPTION OF THE PREFERRED EMBODIMENTS

Image Forming System

Figure 1:
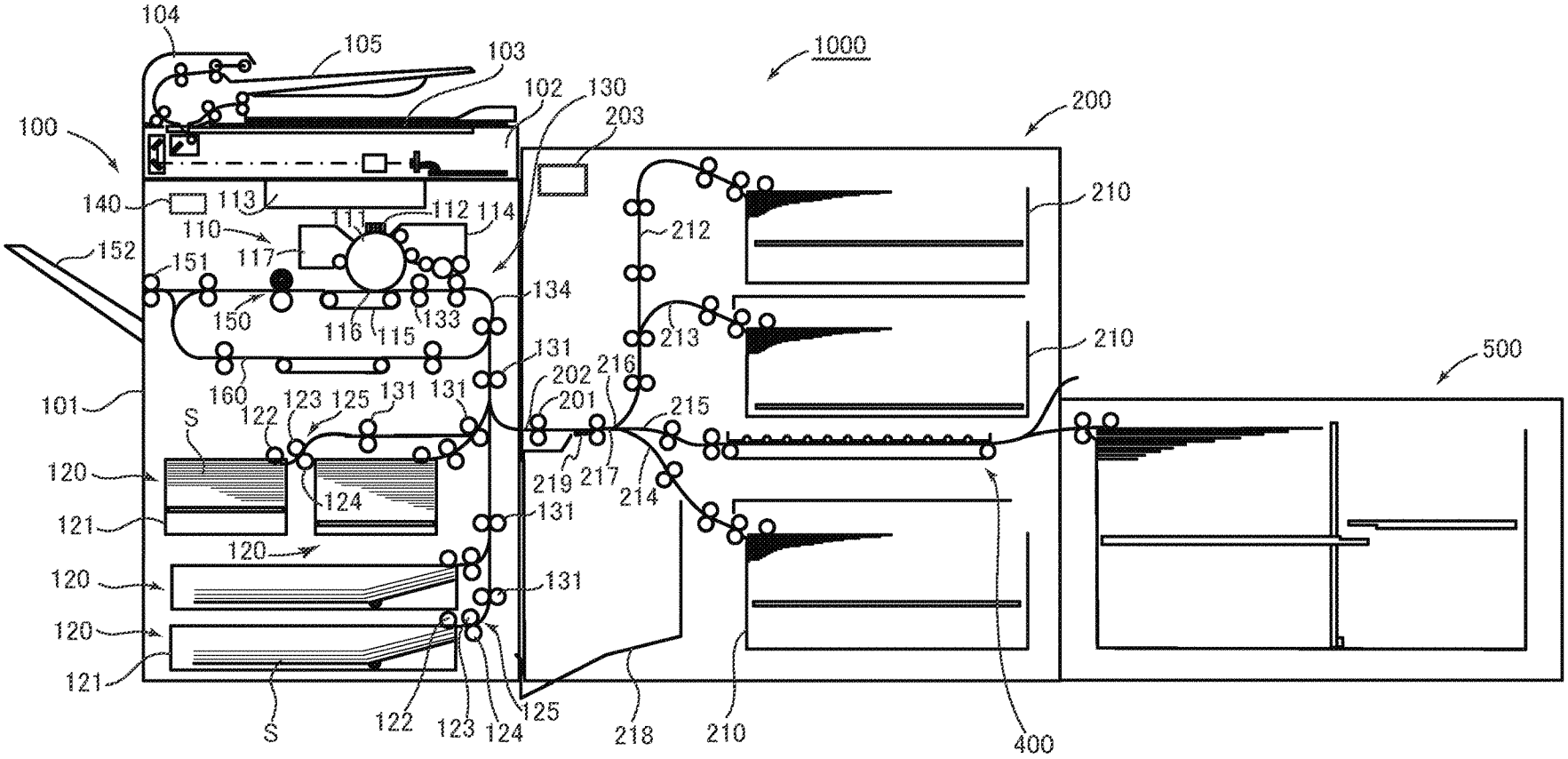
FIG. 1 is a cross-sectional view schematically illustrating the configuration of an image forming system.
Figure 2:
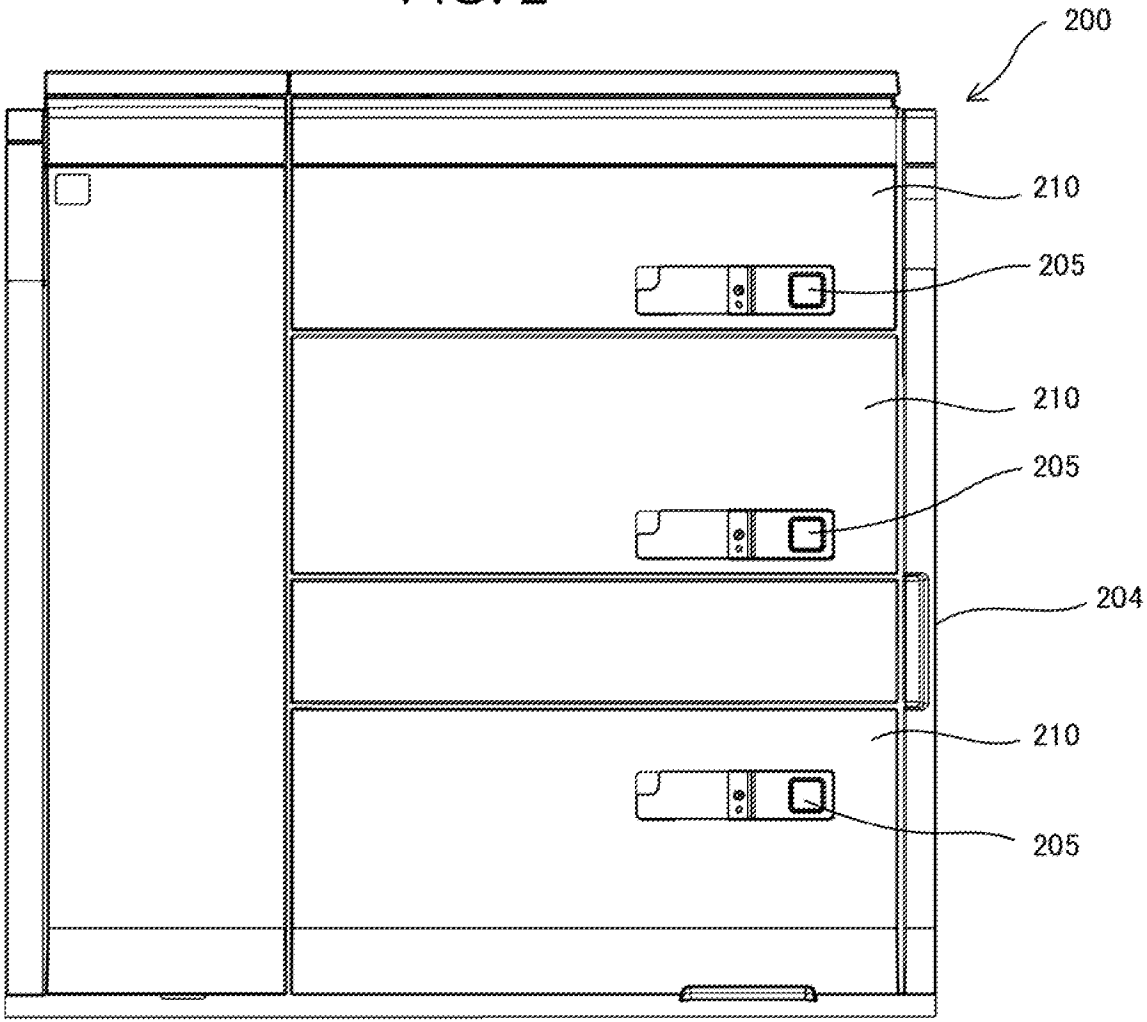
FIG. 2 is a front view of a multi-stage storage.

FIG. 1 is a cross-sectional view schematically illustrating an example of an image forming system according to the present embodiment that is provided with a multi-stage storage and an image forming apparatus. Hereinafter, an electrophotographic laser printer system (hereinafter, referred to merely as "printer") is taken as an example of an image forming apparatus having an image forming part. The image forming apparatus constituting the image forming system is not limited to a printer, but may be a copier, a fax machine, or a multifunction machine. Further, the image forming apparatus is not limited to of an electrophotographic type, but may be of other types such as an inkjet system.

An image forming system 1000 according to the present embodiment has an image forming apparatus 100, a multi-stage storage 200 as a sheet feeding apparatus connected to the image forming apparatus 100, and a feeding deck 500. Although the details will be described later, the multi-stage storage 200 has a plurality of storage cases each capable of storing a plurality of sheets, and the sheets can be fed from each of the storage cases to the image forming apparatus 100. The feeding deck 500, which also has a storage case capable of storing a plurality of sheets, is disposed upstream relative to the multi-stage storage 200 in the sheet conveying direction. The sheet fed from the feeding deck 500 is conveyed to the image forming apparatus 100 through a relay conveying apparatus 400 provided in the multi-stage storage 200. Examples of the sheet include a paper sheet such as a plain paper, a thin paper, or a cardboard, and a plastic sheet.

The image forming apparatus 100 forms a toner image on a sheet according to an image signal from a document reading apparatus 102 connected to an image forming apparatus body 101 or a host device such as a personal computer communicably connected to the image forming apparatus body 101. In the present embodiment, the document reading apparatus 102 is disposed above the image forming apparatus body 101.

The document reading apparatus 102 irradiates light onto a document placed on a platen glass 103 using a scanning optical system light source and inputs reflected light from the document to a CCD to thereby read a document image. The document reading apparatus 102 has an automatic document feeder (ADF) 104 and can automatically convey the document placed on a tray 105 to a reading part of the document reading apparatus 102 using the ADF 104 for document image reading. The read document image is transmitted to a laser scanner 113 of an image forming part 110 to be described later in the form of an electrical signal. The laser scanner 113 may receive image data transmitted from a personal computer or other device, as described above.

The image forming apparatus 100 has an image forming part 110, a plurality of sheet feeding units 120, a sheet conveying unit 130, and other components. The components of the image forming apparatus 100 are each controlled by a control part 140. The control part 140 has a CPU (Central Processing Unit), a ROM (Read Only Memory), and a RAM (Random Access Memory). The CPU controls the components while reading a program corresponding to a control procedure stored in the ROM. The RAM stores therein work data or input data, and the CPU performs control according to the above-mentioned program while referring to the above data stored in the RAM.

The plurality of sheet feeding units 120 each have a cassette 121 for storing sheets S, a pickup roller 122, and a separating and conveying roller pair 125 constituted of a feeding roller 123 and a retard roller 124. The sheets S stored in the cassette 121 are fed one by one by the pickup roller 122 rotating while moving up and down at a predetermined timing and the separating and conveying roller pair 125.

The sheet conveying unit 130 has a conveying roller pair 131 and a registration roller pair 133. The sheet S fed from the sheet feeding unit 120 is made to pass through a sheet conveyance path 134 by the conveying roller pair 131 and is then guided to the registration roller pair 133. Then, the sheet S is fed to the image forming part 110 at a predetermined timing by the registration roller pair 133.

A sheet conveyed from the multi-stage storage 200 and the feeding deck 500 which will be described in greater detail later through a conveying roller pair 201 is then conveyed to the image forming apparatus 100 through a connection path 202 connecting the multi-stage storage 200 and the image forming apparatus 100. Like the sheet conveyed from the sheet feeding unit 120 in the image forming apparatus 100, the sheet conveyed from the multi-stage storage 200 or feeding deck 500 to the image forming apparatus 100 is fed to the image forming part 110 at a predetermined timing through the registration roller pair 133.

The image forming part 110 has a photosensitive drum 111, a charger 112, a laser scanner 113, a developing unit 114, a transfer charger 115, a cleaner 117, and other components. At time of image formation, the photosensitive drum 111 is driven into rotation, and the surface of the photosensitive drum 111 is uniformly charged by the charger 112. Then, a laser light that the laser scanner 113 emits according to an image signal is irradiated onto the charged photosensitive drum 111, whereby an electrostatic latent image is formed on the photosensitive drum 111. The electrostatic latent image thus formed on the photosensitive drum 111 is then visualized as a toner image by the developing unit 114.

Thereafter, the toner image on the photosensitive drum 111 is transferred onto the sheet S by the transfer charger 115 at a transfer part 116. The sheet S onto which the toner image has been transferred is conveyed to a fixing device 150, where the toner image is fixed. After that, the resultant sheet S is discharged to a discharge tray 152 outside the apparatus by a discharge roller 151.

To form a toner image on the back surface of the sheet S, the sheet S discharged from the fixing device 150 is conveyed to a reverse conveyance path 160, where the front and back sides of the sheet S are reversed. Then the resultant sheet S is conveyed once again to the transfer part 116 of the image forming part 110. The sheet S that has been subjected to toner image transfer on the back surface thereof is conveyed to the fixing device 150, where the toner image is fixed, and the resultant sheet S is discharged to the discharge tray 152 by the discharge roller 151. Toner remaining on the photosensitive drum 111 after transfer is removed by a cleaner 117.

Although the above image forming system 1000 has the multi-stage storage 200 and the feeding deck 500 as the sheet feeding apparatuses, it may have only one of them. Alternatively, the image forming system 1000 may additionally have another feeding deck.

Multi-Stage Storage

The following describes the outline of the multi-stage storage 200 with reference to FIG. 1 and FIGS. 3 to 7. The multi-stage storage 200 has a plurality of storage cases 210, a relay conveying apparatus 400, and other components. In the present embodiment, three storage cases 210 are arranged vertically, and the relay conveying apparatus 400 is disposed between the lowermost storage case 210 and the second topmost storage case 210.

A sheet fed from the topmost storage case 210 is conveyed to a conveyance path 212, a sheet fed from the second topmost storage case 210 is conveyed to a conveyance path 213, and a sheet fed from the lowermost storage case 210*c* is conveyed to a conveyance path 214. A sheet fed from the relay conveying apparatus 400 is conveyed to a conveyance path 215. The conveyance path 213 merges with the conveyance path 212 along the way, and the conveyance paths 212, 214, and 215 merge at a merge point 216. Thus, a sheet conveyed along the conveyance paths 212, 213, 214, or 215 is conveyed to a conveying roller pair 201 through a conveyance path 217 and then to the image forming apparatus 100 through the connection path 202.

Figure 3:
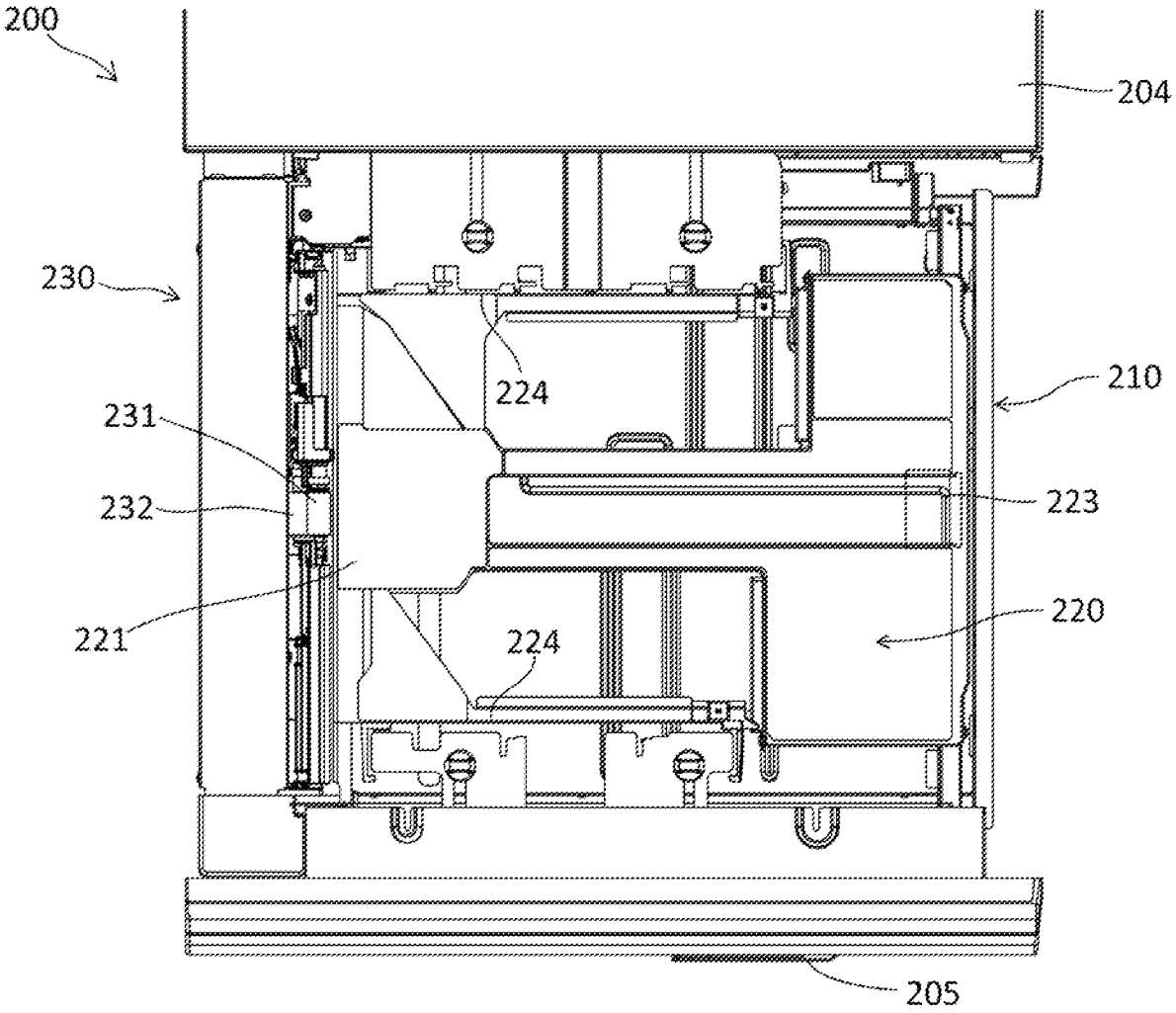
FIG. 3 is a top view of a storage case of the multi-stage storage in a withdrawn state.
Figure 4:
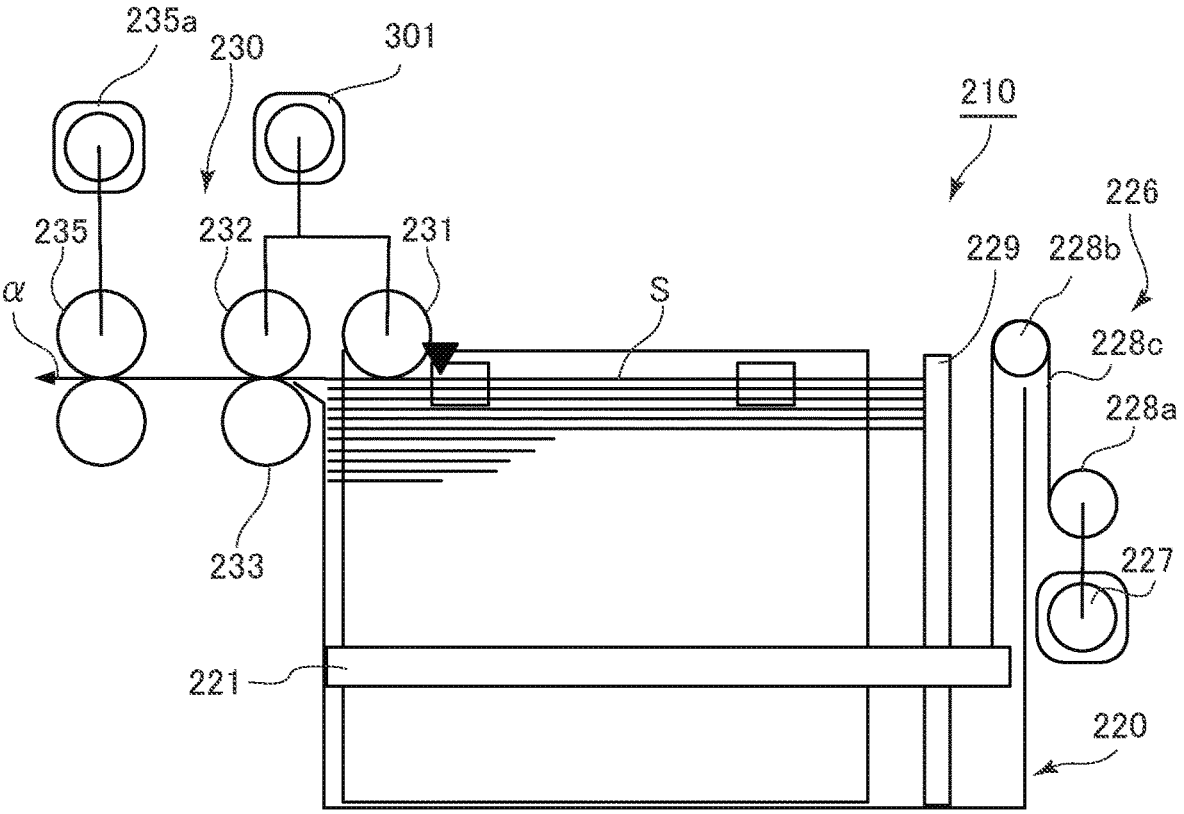
FIG. 4 is a schematic view of the storage case.

As illustrated in FIGS. 3 and 4, the storage case 210 has a sheet storage part 220 capable of storing the sheets S and a sheet feeding part 230 that feeds the sheets S from the sheet storage part 220 toward the image forming apparatus 100. The sheet storage part 220 has a stacking tray 221 on which the sheets S are stacked, an abutting part 222, a rear end regulating plate 223, a side regulating plate 224, and other members. The stacking tray 221 is configured to be vertically movable by an elevating mechanism 226.

The sheet feeding part 230 has a pickup roller 231 as a feeding means and a feeding roller, a conveying roller 232, a retard roller 233, a conveying roller pair 235, and other members. The pickup roller 231 is disposed at an upper part of a storage space 225 at the downstream end in the sheet conveying direction and at substantially the center of the storage space 225 in the width direction.

The pickup roller 231 is provided in the storage case 210 and feeds the sheet stored in the storage case 210. The conveying roller 232 and retard roller 233, which constitute a separation mechanism 234, pressure contact each other to separate the sheets from the pickup roller 231 one from another and convey them one by one. The sheet that has passed through the conveying roller 232 and retard roller 233 is then conveyed, by the conveying roller pair 235 driven into rotation by a conveying motor 235*a*, to a not-shown conveyance path in the multi-stage storage 200 and conveyed to the image forming apparatus 100 through the connection path 202 as described above.

In the present embodiment, the sheet feeding part 230 is provided in the storage case 210 as described above. Thus, when the storage case 210 is withdrawn from and inserted into an enclosure 204 of the multi-stage storage 200, the sheet feeding part 230 is moved together with the storage case 210. The sheet feeding part 230 can thus be withdrawn together with the storage case 210, thereby facilitating maintenance such as replacement of the rollers of the sheet feeding part 230.

Sheet Feeding Part

Figure 7A:
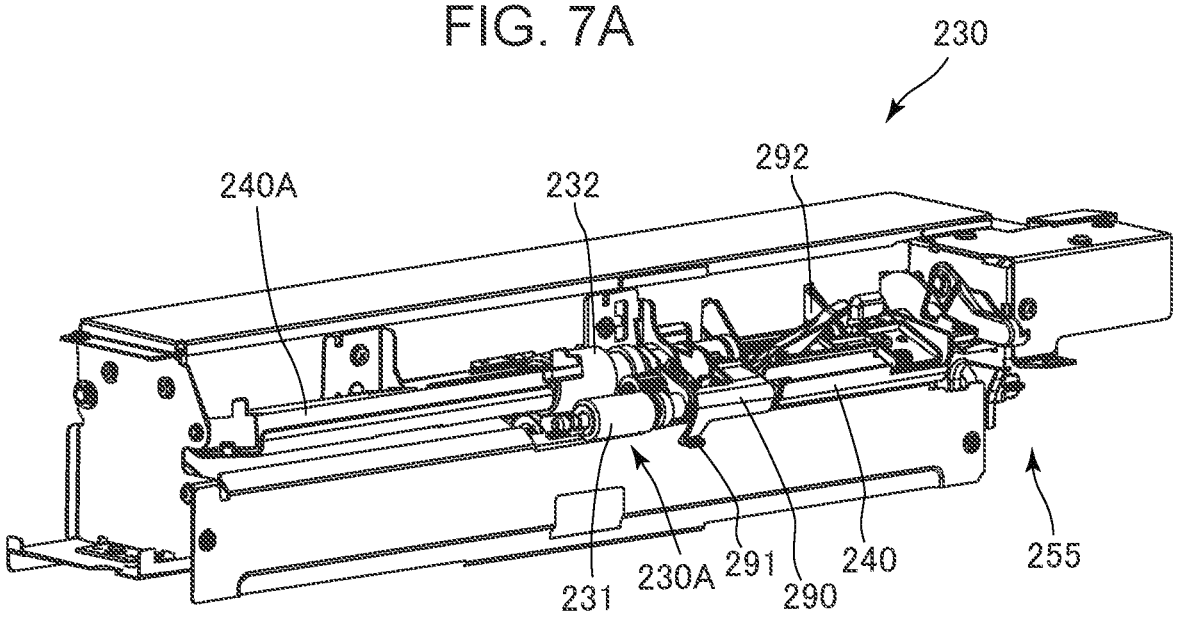
FIG. 7A is a perspective view illustrating a feeding positon of the feeding part.
Figure 7B:
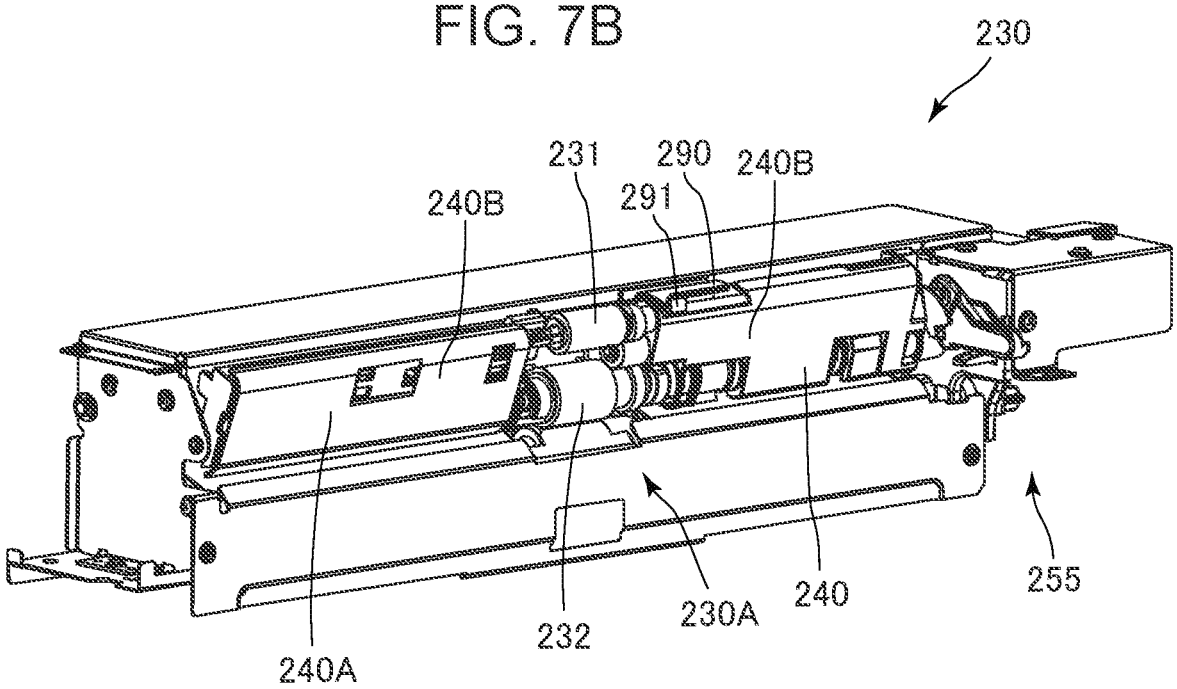
FIG. 7B is a perspective view illustrating a first retracting position of the feeding part.
Figure 8A:
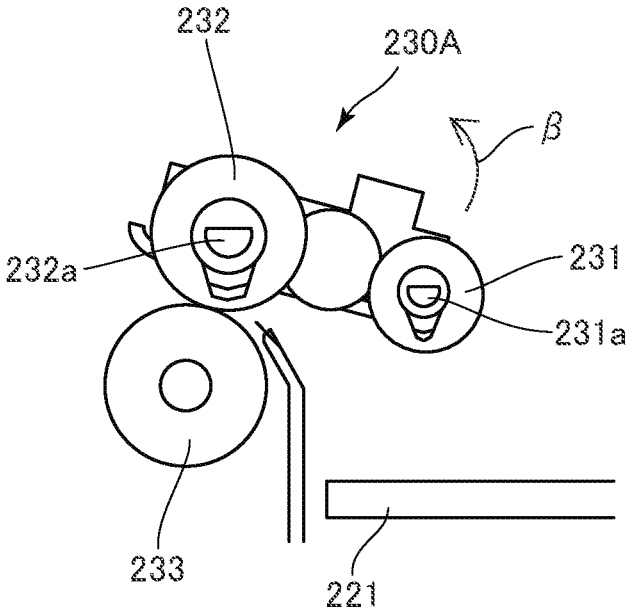
FIG. 8A is a schematic cross-sectional view illustrating the feeding position of the feeding part.
Figure 8B:
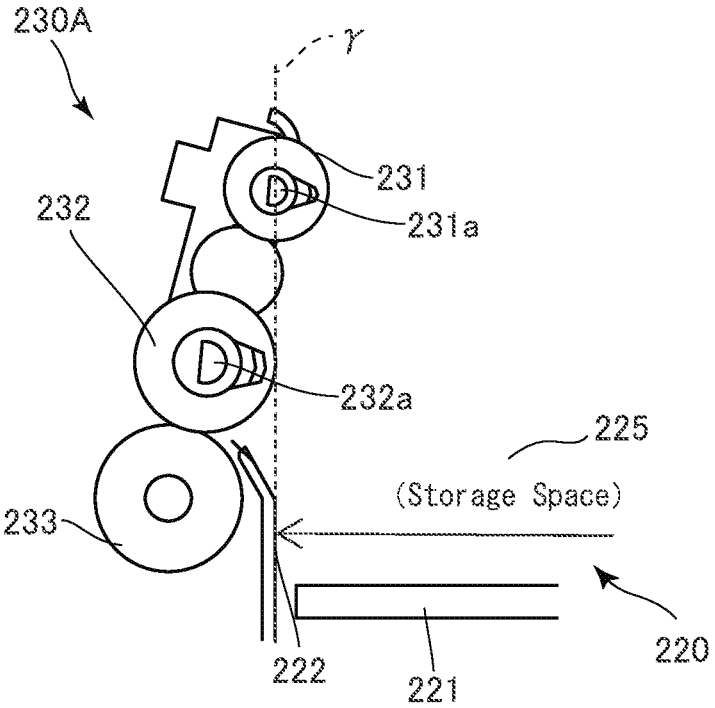
FIG. 8B is a schematic cross-sectional view illustrating the first retracting position of the feeding part.
Figure 9A:
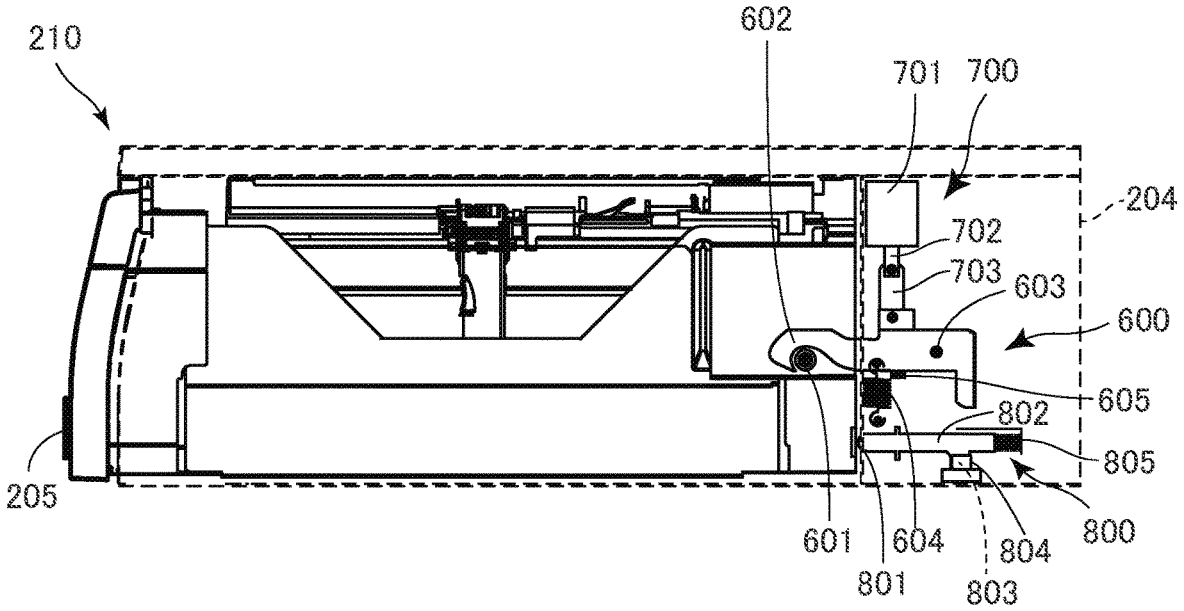
FIG. 9A is a view illustrating a state where the storage case is locked at an attachment position.
Figure 9B:
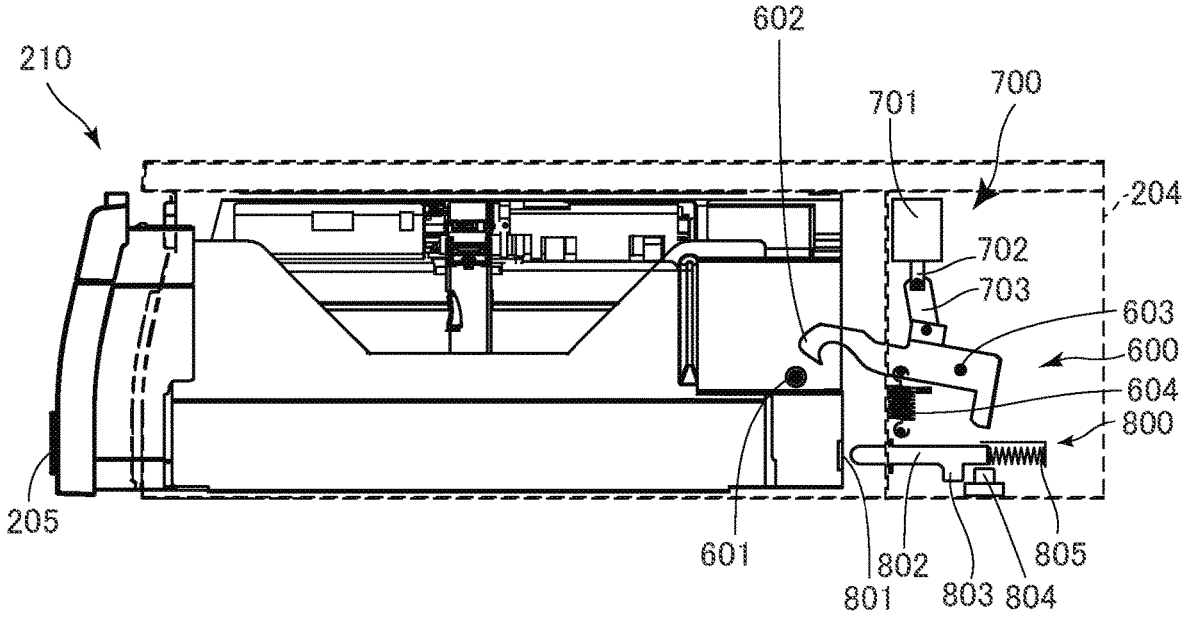
FIG. 9B is a view illustrating a state where lock of the storage case is released.

The following describes the configuration of the sheet feeding part 230 in detail with reference to FIGS. 5, 6, 7, and 8. FIGS. 7A and 7B are perspective views of the sheet feeding part 230 and FIGS. 9A and 9B are schematic views each illustrating a state around the pickup roller 231 and separation mechanism 234. FIGS. 7A and 8A each illustrate a state where the pickup roller 231 is located at a feeding position, and FIGS. 7B and 8B each illustrate a state where the pickup roller 231 is located at a first retracting position as a retracting position.

Figure 5:
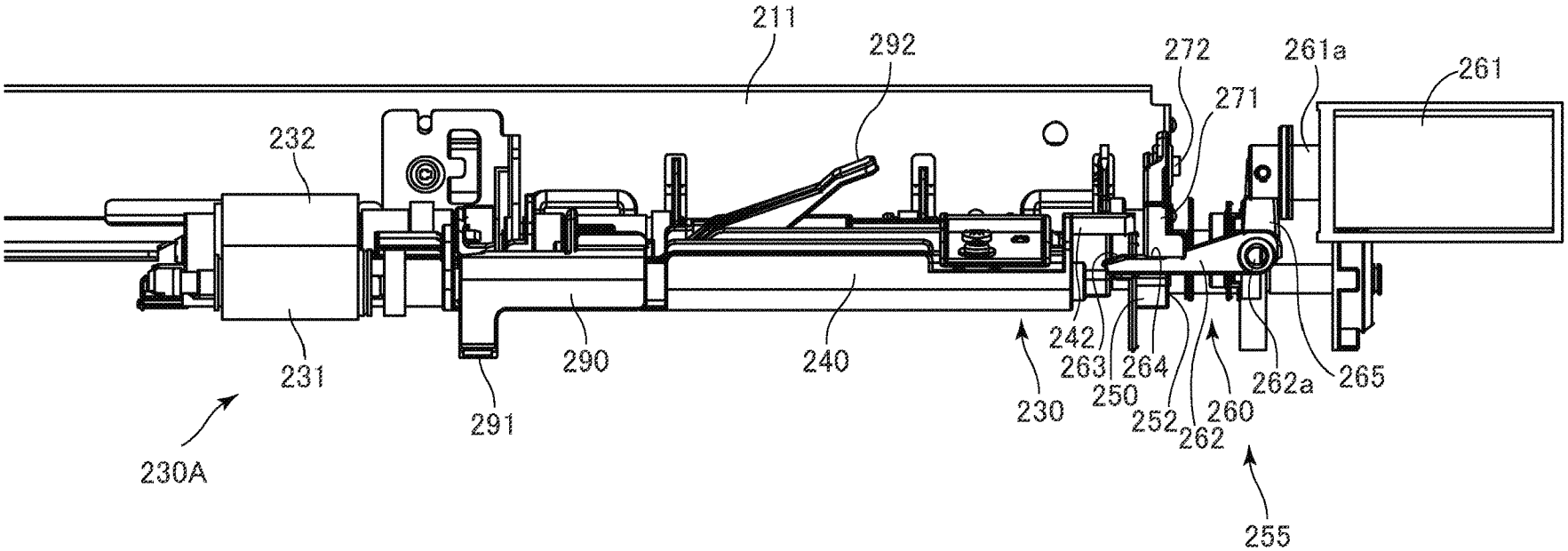
FIG. 5 is a front view illustrating a part of a feeding part.
Figure 6:
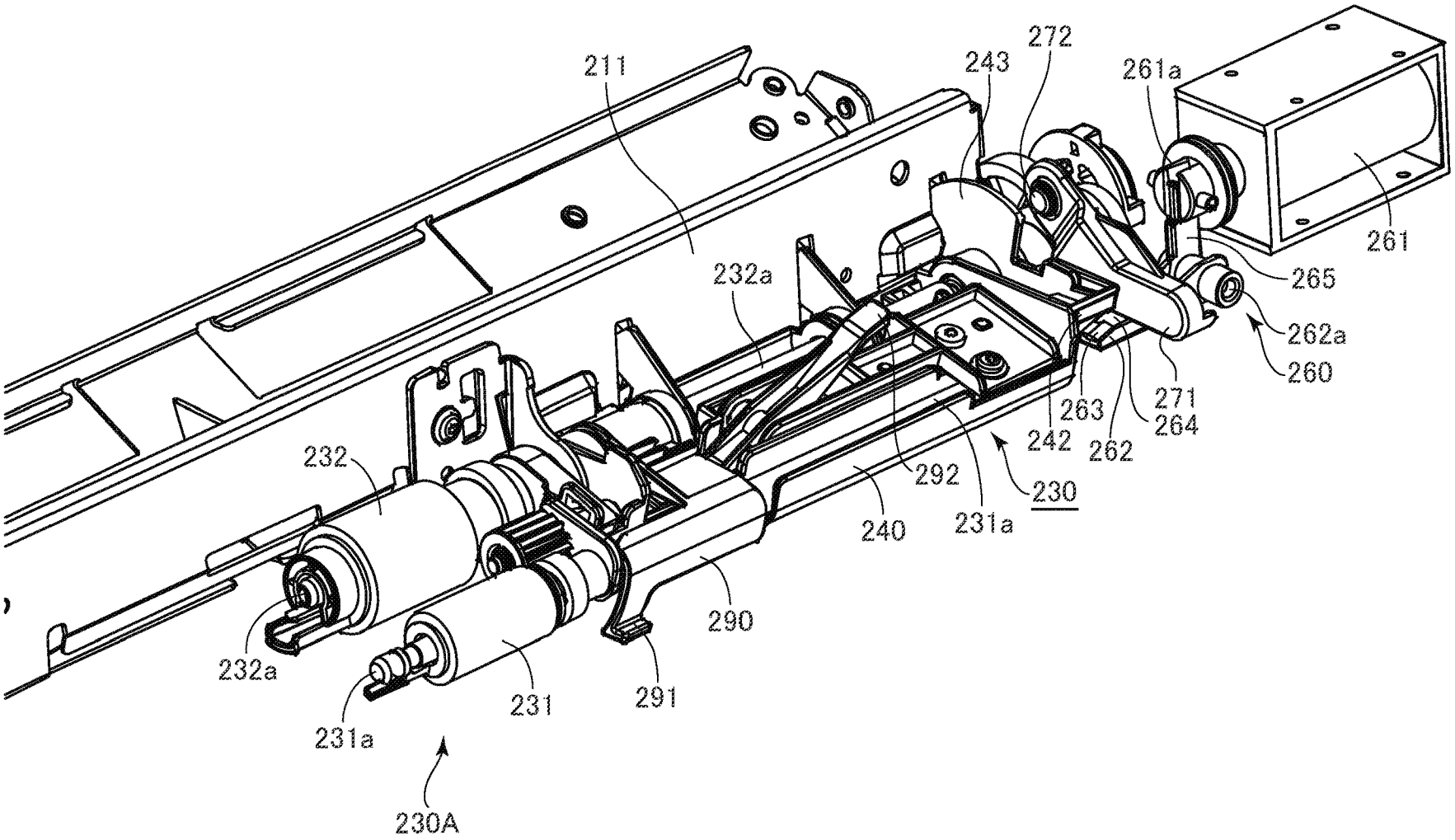
FIG. 6 is a perspective view illustrating a part of the feeding part.

As illustrated in FIGS. 5 and 6, the sheet feeding part 230 has a feeding unit 230A, a moving mechanism 255 as a moving means, and other components. The feeding unit 230A has the pickup roller 231, the separation mechanism 234, a support plate 240 and a guide member 240A. The support plate 240 is a support member for supporting the pickup roller 231. In the present embodiment, the support plate 240 functions also as a guide member for guiding the upper surface of the sheet fed by the pickup roller 231.

As illustrated in FIGS. 7A and 7B, the guide member 240A is disposed on the side opposite to the support plate 240 with respect to the pickup roller 231 and conveying roller 232 in the rotary axis direction of the rotary shafts 231*a* and 232*a*. The guide member 240A guides, together with the support plate 240, the upper surface of the sheet fed by the pickup roller 231. The guide member 240A is detachable at replacement of the pickup roller 231 or conveying roller 232.

The moving mechanism 255 moves the pickup roller 231 between a feeding position where the pickup roller 231 contacts and feeds the sheet and a first retracting position where the pickup roller 231 retracts from the sheet. The moving mechanism 255 of the present embodiment turns the feeding unit 230A about the rotary shaft 232*a* of the conveying roller 232 to thereby move the pickup roller 231 to the first retracting position. The thus configured moving mechanism 255 has a retracting mechanism 250 for making the pickup roller 231 retract from the feeding position, a holding mechanism 260 for holding the pickup roller 231 at a second retracting position to be described later, and other components.

Figure 10:
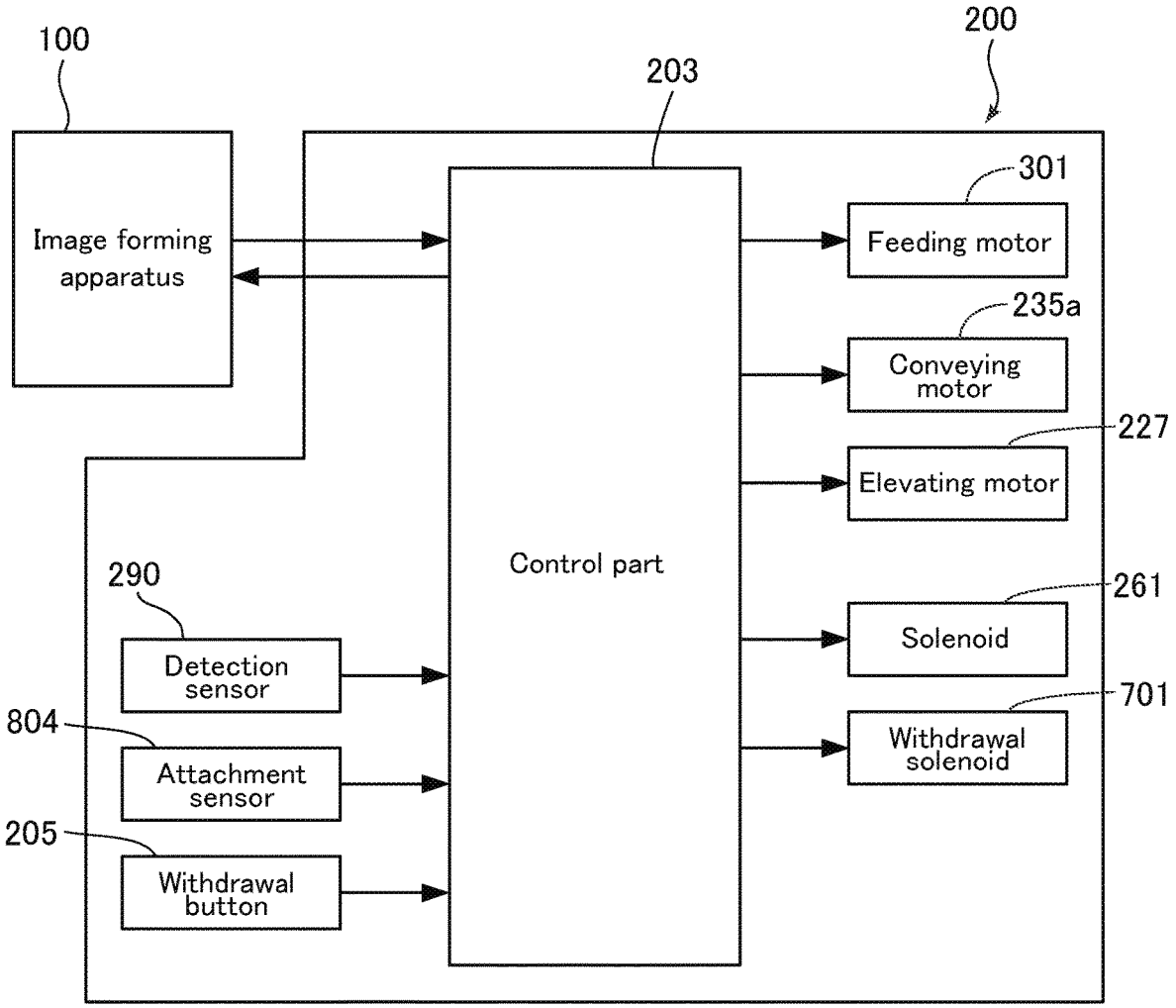
FIG. 10 is a block diagram illustrating a part of the control configuration of the multi-stage storage.

The support plate 240 is freely rotatably supported relative to the rotary shaft 232*a* of the conveying roller 232. That is, the support plate 240 can swing about the rotary shaft 232*a* of the conveying roller 232. The rotary shaft 231*a* of the pickup roller 231 is freely rotatably supported by a rotary support part 241 of the support plate 240 as illustrated in FIG. 10. Thus, when the support plate 240 swings about the rotary shaft 232*a* of the conveying roller 232, the pickup roller 231 also swings about the rotary shaft 232*a*. This vertically moves the pickup roller 231. That is, the pickup roller 231 moves up and down with respect to the sheets stacked on the stacking tray 221. Specifically, the pickup roller 231 can move up and down between the feeding position and the first retracting position.

At the feeding position, the pickup roller 231 abuts against and feeds the uppermost one of the sheets stacked on the stacking tray 221. At this feeding position, the support plate 240 and guide member 240A also face the sheet in the storage case 210 and guide the upper surface of the sheet fed by the pickup roller 231.

The first retracting position is a position where the sheets can be stored in the storage case 210 and where the pickup roller 231 retracts from the storage space 225 by a distance larger than the feeding position when the sheets are stored in the sheet storage part 220. At this first retracting position, the guide surfaces of the support plate 240 and guide member 240A that guide the sheet stand up with respect to a direction in which the pickup roller 231 feeds the sheet as illustrated in FIG. 7B. That is, at the feeding position, the guide surfaces of the support plate 240 and guide member 240A are in parallel to the sheet feeding direction in FIG. 7A; while, at the first retracting position, they move in a direction close to the vertical direction from the feeding position.

The movement of the pickup roller 231 from the feeding position to the first retracting position is performed about the rotary axis of the rotary shaft 232*a* of the conveying roller 232. That is, swinging the feeding unit 230A in a direction of arrow β about the rotary shaft 232*a* from the feeding position as illustrated in FIG. 8A moves the pickup roller 231 to the first retracting position illustrated in FIG. 7B. As illustrated in FIG. 8B, as viewed in the vertical direction, at least a part of the outer peripheral surface of the pickup roller 231 at the first retracting position overlaps the conveying roller 232. In this case, the entire outer peripheral surface of the pickup roller 231 may overlap the conveying roller 232 at the first retracting position as viewed in the vertical direction, while in the present embodiment, a part of the outer peripheral surface of the pickup roller 231 protrudes toward the storage space 225 from the conveying roller 232.

A detection lever 290 of a detection sensor, which detects the presence of any sheet stored in the sheet storage part 220 when the pickup roller 231 is located at the feeding position, is freely swingably supported by the support plate 240. As illustrated in FIG. 5, the detection lever 290 has a contact part 291 that contacts the uppermost one of the sheets stacked on the stacking tray 221. When the contact part 291 contacts the sheet, the detection lever 290 detects the presence of the sheet, and the pickup roller 231 feeds the sheet in response to the detection of the sheet by the detection lever 290.

The thus configured detection lever 290 is configured to retract from a position where it can detect the sheet when the pickup roller 231 supported by the support plate 240 moves to the first retracting position. That is, when the pickup roller 231 supported by the support plate 240 is located at the feeding position, the detection lever 290 is located at a first position where the contact part 291 protrudes to the sheet side from the pickup roller 231 in a state where the sheets stored in the sheet storage part 220 do not contact the pickup roller 231. On the other hand, when the pickup roller 231 supported by the support plate 240 is located at the first retracting position, the detection lever 290 is located at a second position where the contact part 291 does not protrude from the pickup roller 231 with respect to the first position.

To realize the above configuration, a retracting lever 292 is freely swingably supported by the support plate 240. The retracting lever 292 is disposed such that one end portion thereof in the longitudinal direction is positioned below the detection lever 290 with respect to the swing axis, and the other end portion thereof in the longitudinal direction protrudes upward at the feeding position. When the pickup roller 231 supported by the support plate 240 moves to the first retracting position, the other end portion of the retracting lever 292 abuts against the frame 211 to swing about the swing axis, with the result that the one end portion of the retracting lever 292 lifts the detection lever 290. Thus, the detection lever 290 swings to locate the contact part 291 at the second position.

Further, a support plate side engagement part 242 is integrally formed at the end portion of the support plate 240. The support plate side engagement part 242 is formed so as to protrude from the rotary support part 241 on one side in the direction of the rotary axis of the rotary shaft 232*a* and can be engaged with a retracting engagement part 254 of a retracting mechanism 250 to be described below.

As illustrated in FIGS. 5 and 6, the retracting mechanism 250 has a retracting member 251 as a retracting means which is disposed around the rotary shaft 232*a* of the conveying roller 232 and outside the support plate 240 and a one-way clutch 252 which is disposed between the retracting member 251 and the rotary shaft 232*a*. The retracting member 251 is constituted of a support part 251*a*, a locking engagement part 253, a retracting engagement part 254, and other members.

The holding mechanism 260 has a solenoid 261 and a holding lever 262 driven by the solenoid 261. When the solenoid 261 is turned ON by energization, a plunger 261*a* retracts; when it is turned OFF (not energized), the plunger 261*a* protrudes. The holding lever 262 can vertically swing about a swing shaft 262*a* extending in a direction perpendicular to the advancing and retracting direction of the plunger 261*a*. Further, a first engagement part 263 that can be engaged with the support plate side engagement part 242 of the support plate 240 is provided on the upper surface of the leading end portion of the holding lever 262, and a second engagement part 264 that can be engaged with the lower surface of the swing lever 271 is provided on a part of the upper surface of the holding lever 262 that is positioned between the first engagement part 263 and the swing shaft 262*a*.

Lock and Lock Release of Storage Case

The following describes lock/lock release of the storage case 210 to/from an attachment position in the enclosure 204 with reference to FIGS. 9A and 9B. A lock mechanism 600 is a mechanism for holding the storage case 210 at the attachment position in the enclosure. The lock mechanism 600 has a lock pin 601 provided on the side plate of the storage case 210, a lock pawl 602 provided on the enclosure 204 side so as to be engageable with the lock pin 601, and a tension spring 604.

A lock release mechanism 700 is a mechanism that releases hold of the storage case 210 by the lock mechanism 600. The lock release mechanism 700 has a withdrawal solenoid 701 and a link member 703 for linking a plunger 702 of the withdrawal solenoid 701 and the lock pawl 602.

The lock pin 601 and lock pawl 602 are each provided on both the front and rear sides of the multi-stage storage 200. The lock pawls 602 on the front and rear sides are connected through a support shaft 603, whereby they can be activated by the single withdrawal solenoid 701. The front side of the apparatus is the near side of the paper surface of FIGS. 9A and 9B, which is the same as the near side (user operation side) of the image forming apparatus 100. The rear side of the apparatus is the far side of the paper surface of FIGS. 9A and 9B.

Storage Case Attachment Detection Mechanism

The following describes a mechanism for detecting whether the storage case 210 has been withdrawn from the enclosure 204 and whether it has been attached thereto with reference to FIGS. 9A and 9B. A detection mechanism 800 as a detection means can detect that the storage case 210 has been moved from a withdrawal position from inside the enclosure 204 to the attachment position and that the storage case 210 has been moved from the attachment position to the withdrawal position.

Control Configuration

The following describes a control configuration of the multi-stage storage 200 according to the present embodiment. The multi-stage storage 200 has a control part 203 for controlling the components of the multi-stage storage 200. Specifically, the control part 203 receives an instruction from the image forming apparatus 100 or a signal from various sensors such as the detection lever 290, an attachment sensor 804 and a withdrawal button 205, and controls various motors such as a feeding motor 301, a conveying motor 235*a*, an elevating motor 227 or solenoids 261 and 701 based on the received instruction or signal.

Storage Case Withdrawal Operation

Figure 11:
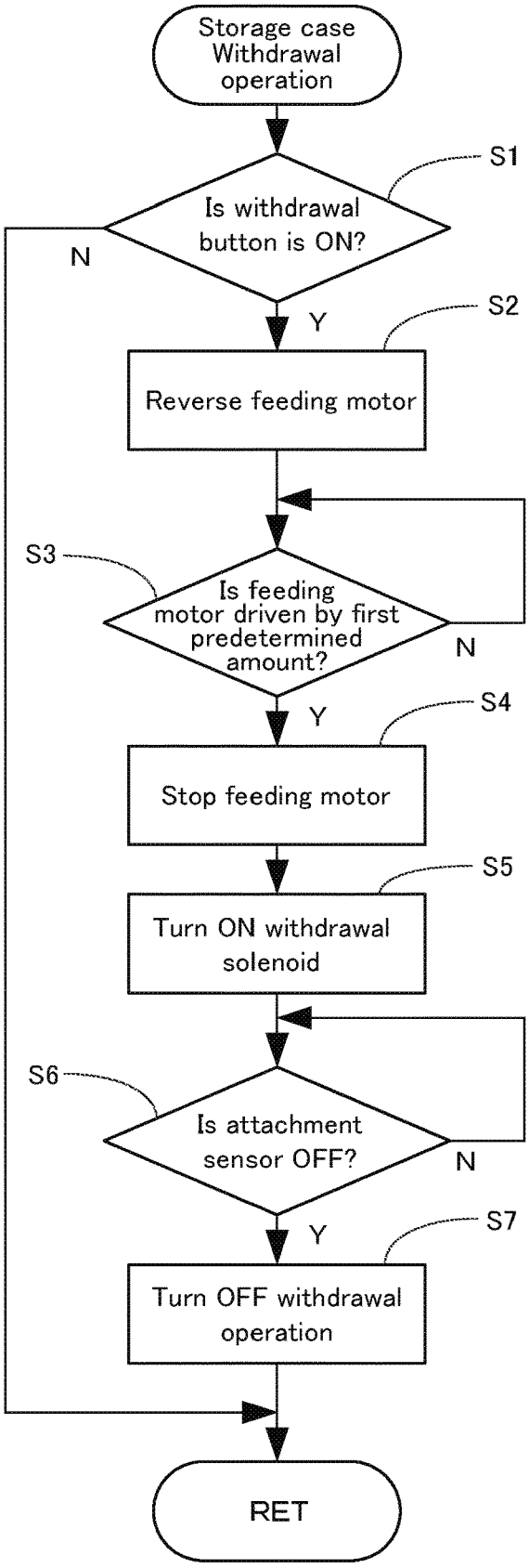
FIG. 11 is a flowchart of a withdrawal operation of the storage case.

The following describes an operation of withdrawing the storage case 210 from the enclosure 204 with reference to FIG. 11. The control part 203 detects a press on the withdrawal button 205 (Y in S1) and then reverses the feeding motor 301 (S2). As a result, the feeding unit 230A including the pickup roller 231 starts turning upward about the rotary shaft 232*a* of the conveying roller 232 (FIGS. 8A and 8B). Thereafter, the control part 203 drives the feeding motor 301 by a first predetermined amount and stops it (S3, S4). At this time, the feeding unit 203A has moved to the first retracting position (FIG. 8B). That is, the moving mechanism 255 moves the pickup roller 231 to the first retracting position in response to a press on the withdrawal button 205 (based on an instruction from a release instruction means).

As described above, at the first retracting position, the pickup roller 231 is positioned such that a part of the outer periphery thereof is immediately above the conveying roller 232, and the support plate 240 and guide member 240A of the feeding unit 230A stand up in substantially the vertical direction (FIG. 7B). The above first predetermined amount for driving the feeding motor 301 corresponds to a drive amount for the feeding unit 230A to move from the feeding position to the first retracting position. The operation of moving to the first retracting position will be described later in detail.

When the feeding unit 230A moves to the first retracting position, the control part 203 turns ON (energizes) the withdrawal solenoid 701 (S5). As a result, the plunger 702 of the withdrawal solenoid 701 is sucked (pulled) to cause the lock pawl 602 to turn up and move to a position releasing the engagement with the lock pin 601 (FIG. 9B). That is, in response to a press on the withdrawal button 205 (based on an instruction from a release instruction means), the lock release mechanism 700 releases hold of the storage case 210 by the lock mechanism 600 after the moving mechanism 255 moves the pickup roller 231 to first retracting position.

When the lock of the storage case 210 is released by the movement of the lock pawl 602, an operator manually withdraws the storage case 210 including the sheet feeding part 230. At this time, as illustrated in FIG. 9B, a detection piece 802 of the detection mechanism 800 slides following the withdrawal of the storage case 210 by the biasing force of a spring 805. Then, the attachment sensor 804 is turned OFF at the time when a detection flag 807 falls outside the detection range of the attachment sensor 804, whereby the withdrawal of the storage case 210 is detected (S6). When the withdrawal of the storage case 210 is detected, the withdrawal solenoid 701 is turned OFF (energization is interrupted) (S7). This brings the plunger 702 of the withdrawal solenoid 701 into a free state, with the result that the lock pawl 602 moves to a lock position by the action of the tension spring 604.

Here, movement of the feeding unit 230A from the feeding position to the first retracting position at the time of withdrawal of the storage case 210 will be described in detail. When the operator operates the withdrawal button 205 as described above, the feeding motor 301 is reversed to locate the pickup roller 231 at the first retracting position. That is, in a state where the storage case 210 is attached to a predetermined attachment position, the pickup roller 231 supported by the support plate 240 is located at the feeding position (FIGS. 7A, 8A), and the drive of the feeding motor 301 can be transmitted to the conveying roller 232.

Figure 13A:
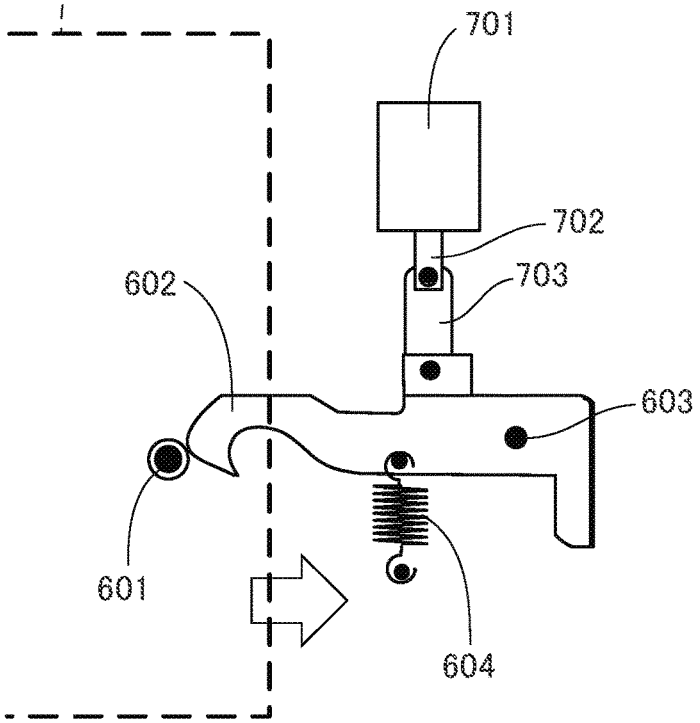
FIG. 13A is a view illustrating a state where a lock pin starts contacting a lock pawl at the time of the operation of attaching the storage case according to the embodiment.

Then, the rotary shaft 232*a* of the conveying roller 232 rotates, and this rotation is transmitted to the retracting member 251 through the one-way clutch 252. As described above, the one-way clutch 252 transmits the drive of the reverse rotation of the feeding motor 301 to the retracting member 251. Thus, when the feeding motor 301 is reversely rotated, the retracting member 251 receives the drive of the reverse rotation through the rotary shaft 232*a* and one-way clutch 252 to rotate in the clockwise direction shown in FIG. 13A, and the retracting engagement part 254 also rotates in the same direction together with the retracting member 251. Then, as described above, the retracting side engagement surface 254*a* of the retracting engagement part 254 is engaged with the support plate side engagement part 242. When the retracting member 251 further rotates, the support plate 240 and pickup roller 231 move to the first retracting position.

At this time, the locking engagement part 253 constituting the retracting member 251 also rotates in the same direction, which, as described above, causes the slope 253*a* to be engaged with the engagement surface 273*a* of the swing lever 271 to lift the swing lever 271. Then, when the slope 253*a* rides over the engagement surface 273*a*, the swing lever 271 swings downward to allow engagement of the lever side engagement part 273 with the locking engagement part 253, as illustrated in FIG. 10. As a result, the retracting member 251 is locked at this position, preventing the retracting member 251 from inadvertently rotating in a direction moving the pickup roller 231 supported by the support plate 240 to the feeding position even when the drive transmission from the feeding motor 301 is interrupted. Further, when the retracting member 251 is thus locked, the pickup roller 231 supported by the support plate 240 being located at the first retracting position by the engagement with the retracting engagement part 254 is also locked at the first retracting position.

When the pickup roller 231 is thus locked at the first retracting position as described above, the control part 203 releases the lock mechanism 600 that is locking the storage case 210 at a predetermined attachment position. When the control part 203 releases the above lock mechanism, the storage case 210 is pushed out from the enclosure 204 by a not-shown spring, allowing the storage case 210 to be withdrawn to a position allowing sheets to be stored therein. In the present embodiment, when the storage case 210 is thus withdrawn, the feeding unit 230A including the pickup roller 231 is made to retract to the first retracting position and locked at this position. That is, the moving mechanism 255 makes the pickup roller 231 to retract to the first retracting position before the storage case 210 is withdrawn from the enclosure 204. Thus, when the operator stores sheets in the sheet storage part 220, the pickup roller 231 does not become an obstacle, allowing the operator to easily store the sheets in the sheet storage part 220.

Further, by thus moving the feeding unit 230A including the pickup roller 231 to the first retracting position before the storage case 210 is withdrawn from the enclosure 204, it is possible to prevent an operator (user) from touching the pickup roller 231 when he or she stores sheets in the storage case 210. Thus, a configuration may be possible, in which, after withdrawing the storage case 210, the operator manually moves the feeding unit 230A from the feeding position to the retracting position allowing the sheet to be stored in the storage case 210. However, in this case, the operator may unintentionally touch the pickup roller 231 or conveying roller 232 with his or her hand. As described above, touching the roller with hand may unfavorably cause dirt and oil to adhere to the roller. On the other hand, in the present embodiment, the feeding unit 230A has already moved to the first retracting position allowing the sheet to be stored when the storage case 210 is withdrawn, making it possible to prevent the operator unintentionally from touching the roller.

Storage Case Attachment Operation

Figure 12:
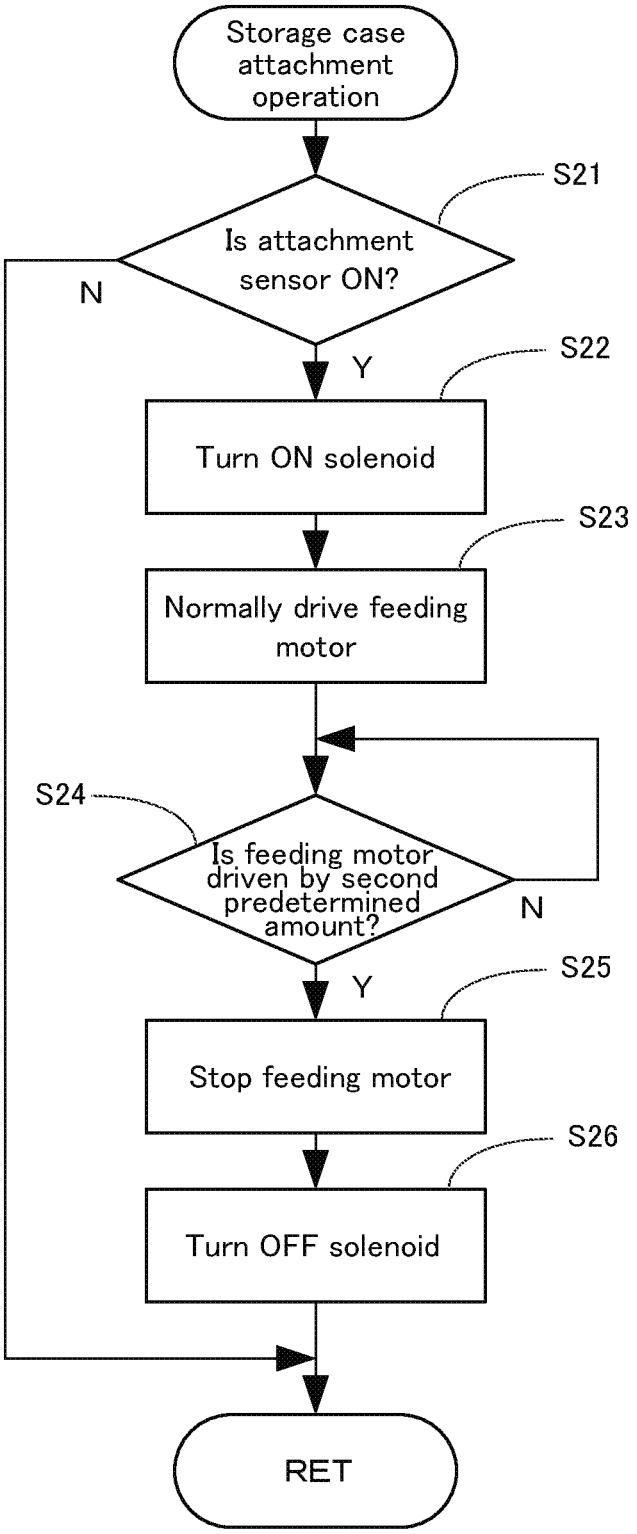
FIG. 12 is a flowchart of an operation of attaching the storage case according to the embodiment.
Figure 13B:
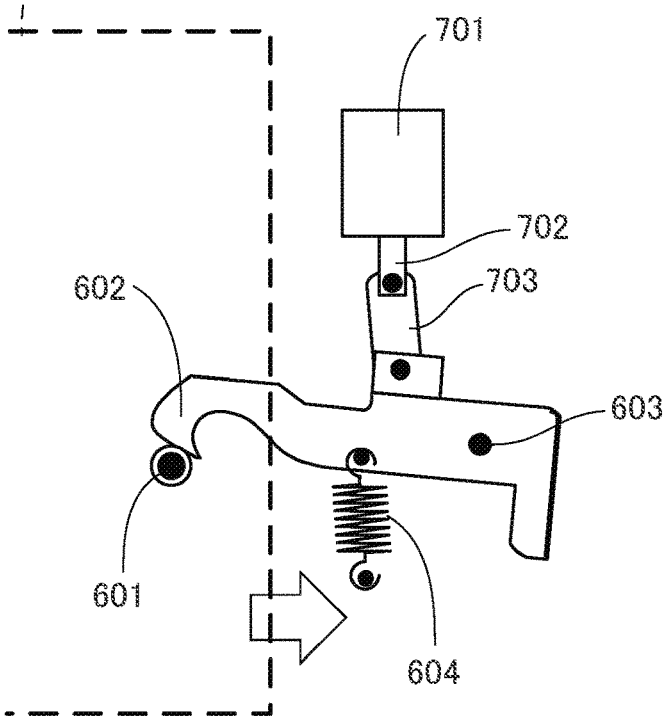
FIG. 13B is a view illustrating a state where the lock pawl is pushed by the lock pin to swing.

The following describes a storage case attachment operation with reference to FIGS. 12 and 13. When the attachment sensor 804 detects the storage case 210 having been attached to a predetermined attachment position in the enclosure 204 (S21), the control part 203 turns ON the solenoid 261 (S22). Then, the plunger 261*a* illustrated in FIGS. 5 and 6 retracts to cause the holding lever 262 to swing upward about the swing shaft 262*a*. At this time, the second engagement part 264 of the swing lever 271 is engaged with the lower surface of the swing lever 271 to lift the swing lever 271. That is, the holding mechanism 260 is located at the holding position. As a result, the engagement between the lever side engagement part 273 of the swing lever 271 and the locking engagement part 253 of the retracting member 251 is released to release the lock of the retracting member 251. That is, the lock mechanism 600 releases the lock of the support plate 240 through the operation of switching the holding mechanism 260 to the holding position.

Then, the control part 203 normally rotates the feeding motor 301 (S23). The normal rotation of the feeding motor 301 rotates the retracting member 251 in the counterclockwise direction. The counterclockwise rotation of the retracting member 251 causes the pickup roller 231 supported by the support plate 240 to swing in a direction from the first retracting position toward the feeding position by its own weight and the biasing force of a biasing spring 280.

The pickup roller 231 supported by the support plate 240 swings to a second retracting position. The second retracting position refers to a position lying between the first retracting position and the feeding position, where the pickup roller 231 does not contact the uppermost sheet even when the amount of sheets stored in the sheet storage part 220 is maximum. At this second retracting position, the rotary axis of the pickup roller 231 is positioned vertically below the rotary axis (swing center of the swing shaft) of the conveying roller 232.

At this time, the solenoid 261 is kept in an ON state, and the holding lever 262 remains lifting the swing lever 271. Thus, when the pickup roller 231 supported by the support plate 240 swings to the second retracting position, the first engagement part 263 of the holding lever 262 is engaged with the support plate side engagement part 242 of the support plate 240 to hold the pickup roller 231 at the second retracting position.

The control part 203 further normally rotates the feeding motor 301 in a state where the pickup roller 231 is held at the second retracting position. Then, the retracting member 251 rotates to release the engagement between the retracting engagement part 254 and the support plate side engagement part 242. That is, the control part 203 rotates the feeding motor 301 by a second predetermined amount in a state where the pickup roller 231 is held at the second retracting position (S24).

Specifically, the control part 203 continues rotating the feeding motor 301 such that the retracting engagement part 254 separates sufficiently from the support plate side engagement part 242 and moves to a predetermined position allowing the pickup roller 231 supported by the support plate 240 to move to the feeding position. In the present embodiment, the feeding motor 301 is a pulse motor, so that the above first predetermined amount and the second predetermined amount are a predetermined first pulse number and a predetermined second pulse number, respectively. Even when the feeding motor 301 is a DC motor, it is possible to control the first and second predetermined amounts of rotation by providing an encoder capable of detecting a motor rotation amount.

As described above, the retracting member 251 allows the pickup roller 231 to move to the feeding position when the feeding motor 301 normally rotates in a state where the pickup roller 231 is held at the second retracting position. Even in this state, the pickup roller 231 is held at the second retracting position by the holding lever 262. Then, after rotation of the retracting member 251 to a predetermined position, the rotation of the feeding motor 301 is stopped (S25).

After stopping the drive of the feeding motor 301, the control part 203 turns OFF the solenoid 261 (S26). Then, the holding lever 262 swings downward about the swing shaft 262*a* and, accordingly, the support plate 240 also swings downward by its own weight and biasing force of the biasing spring 280, with the result that the pickup roller 231 supported by the support plate 240 moves to the feeding position. The retracting engagement part 254 of the retracting member 251 has a stopper surface 254*b* on the side opposite to the retracting side engagement surface 254*a*. The stopper surface 254*b* is configured to be engaged with a not-shown stopper provided in the enclosure 204 so as to prevent the retracting member 251 from rotating excessively.

Support Configuration of Pickup Roller 231 and Conveying Roller 232

Figure 14A:
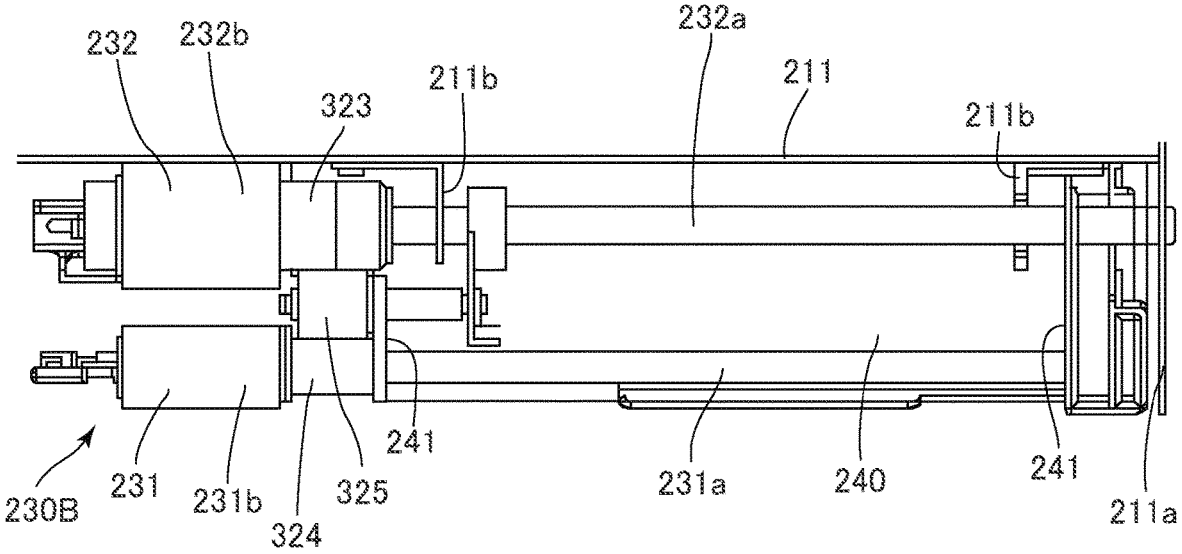
FIG. 14A is a top view illustrating a support member of the feeding part.
Figure 14B:
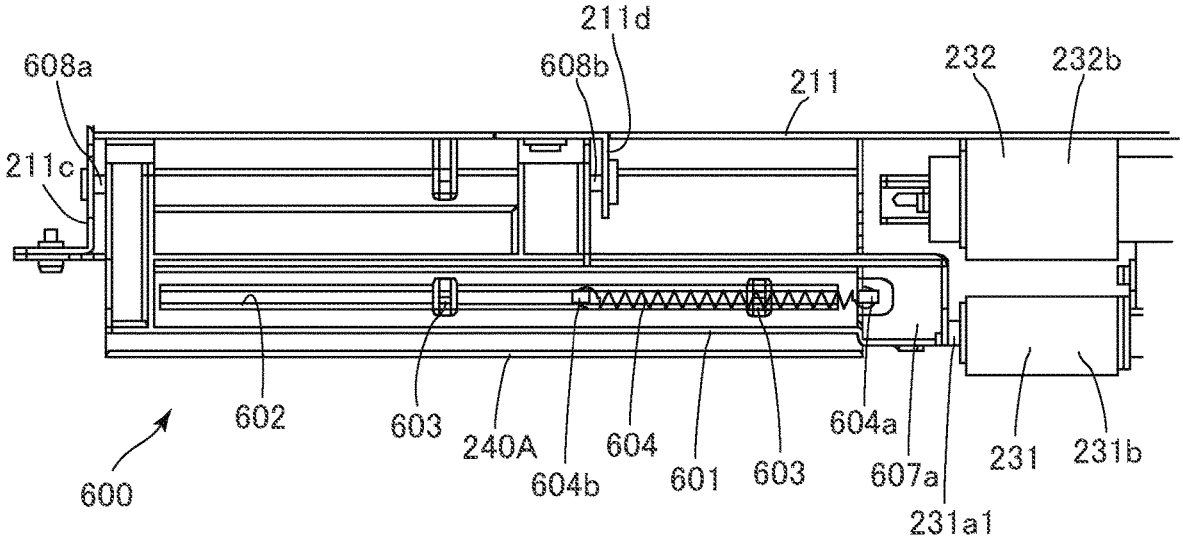
FIG. 14B is a top view illustrating a guide member of the feeding part.

The following describes a support configuration of the pickup roller 231 and the conveying roller 232 with reference to FIGS. 14A and 14B. The pickup roller 231 and the conveying roller 232 are cantilevered, that is, supported only at their respective rear sides of roller parts 231*b* and 232*b*. This allows the roller parts 231*b* and 232*b* to be detached from the rotary shafts 231*a* and 232*a* without removal of the rotary shafts 231*a* and 232*a*.

Configuration of Guide Member

The following describes the configurations of the support plate 240 and guide member 240A with reference to FIGS. 14A and 14B. The rear side support plate 240 is disposed on one side (rear side) of the roller parts 231*b* and 232*b* supported respectively by the rotary shafts 231*a* and 232*a*. The support plate 240 is combined integrally with the pickup roller 231, conveying roller 232, a plurality of gears 323 to 325, and other members into one unit, i.e., a roller unit 230B. As described above, when the storage case 210 is withdrawn, the support plate 240 turns to the first retracting position about the rotary shaft 232*a* to stand up so as not to be obstructive to the loading of sheets. The front side guide member 240A is disposed on the other side (front side) of the roller parts 231*b* and 232*b* supported by the rotary shafts 231*a* and 232*a*. The guide member 240A constitutes a guide unit 600 together with a slide support part 601 that slidably supports the guide member 240A in the rotary axis direction (extending direction of the rotary shafts 231*a* and 232*a*) of the pickup roller 231.

The slide support part 601 supports the support plate 240 such that the support plate 240 can slide between a proximity position proximate to the conveying roller 232 and a separation position separating from the conveying roller 232. The slide support part 601 has turning pins 608*a* and 608*b* as a turning support part. The turning pins 608*a* and 608*b* support the guide member 240A such that the guide member 240A can turn with respect to the pickup roller 231 in a direction crossing the extending direction of the rotary shafts 231*a* and 232*a*. The turning pin 608*a* penetrates an engagement hole formed in a front-side side plate 211*c* of the feeding unit 230A and supported thereby. The turning pin 608*b* penetrates an engagement hole formed in a bracket 211*d* attached to the frame 211 and is supported by the engagement hole. Thus, the slide support part 601 is attached to the feeding unit 230A so as to be turnable about the turning pins 608*a* and 608*b*.

Thus, the guide unit 600 including the slide support part 601 and guide member 240A can turn, together with the support plate 240, to a guide position for guiding the sheet and a stand-up position retracting from immediately above the stacking tray 221 in a stand-up posture. Further, as described later, the guide unit 600 can turn about the turning pins 608*a* and 608*b* with respect to the roller unit 230B including the support plate 240 and pickup roller 231.

The upward turning of the guide unit 600 is regulated by abutment of the slide support part 601 against the frame 21. The downward turning of the guide unit 600 is regulated by abutment of the downstream end portion of the guide member 240A in the sheet feeding direction against the lower end of the frame 211.

Further, at the position where the downward turning of the guide member 240A is restricted, the guide member 240A does not abut against a free end portion 231*a*1 of the rotary shaft 231*a* of the pickup roller 231. As described above, at the time of withdrawal of the storage case 210, the pickup roller 231 abuts against a part of the guide unit 600 at the free end portion 231*a*1 of its rotary shaft 231*a* while turning toward the first retracting position to turn the guide member 240A to the first retracting position. In the present embodiment, the part of the guide unit 600 abutting against the free end portion 231*a*1 of the rotary shaft 231*a* is a leading end portion 607*a* of an extending portion 607 of the slide support part 601. The leading end portion 607*a* serves also as a regulating part for regulating the guide member 240A at a position adjacent to the roller part 231*b* of the pickup roller 231 in a state where the guide member 240A is at the guide position.

The following specifically describes replacement of the roller parts 231*b* and 232*b* of the respective pickup roller 231 and conveying roller 232 with reference to FIGS. 15A to 15C and FIGS. 16A and 16B.

Replacement of Pickup Roller

Figure 15A:
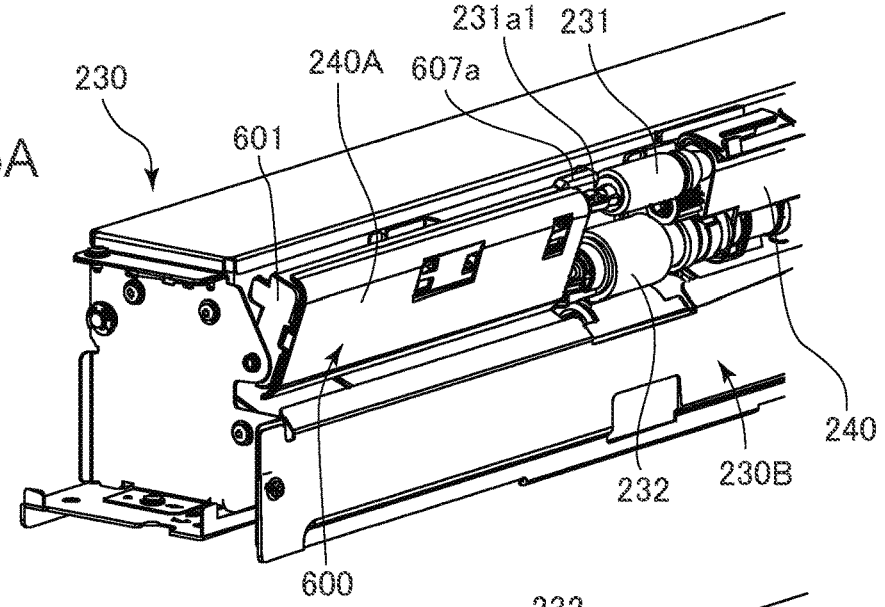
FIG. 15A is a perspective view illustrating the first retracting position of the feeding part.
Figure 15B:
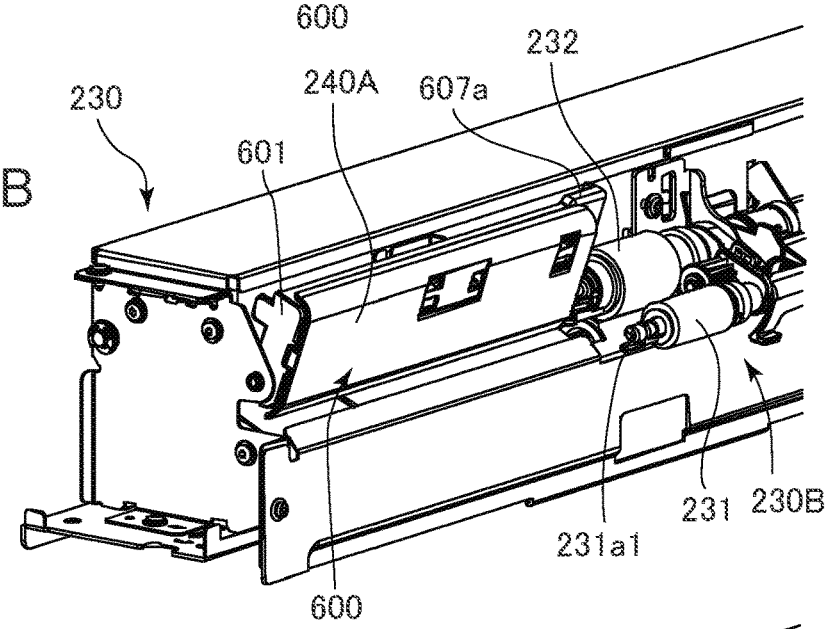
FIG. 15B is a perspective view illustrating a state where a pickup roller in a state of FIG. 15A is moved to the lowermost position.

First, replacement of the roller part 231*b* of the pickup roller 231 will be described. As described above, when the storage case 210 is withdrawn, the feeding unit 230A is located at the first retracting position, as illustrated in FIG. 15A. Accordingly, the guide unit 600 is also located at the stand-up position. To perform replacement of the roller part 231*b* of the pickup roller 231, the roller unit 230B at the first retracting position (first position) is manually moved to the lowermost position (second position) that is lower than the feeding position, as illustrated in FIG. 15B, to ensure a space for pulling out the roller part 231*b* of the pickup roller 231. That is, the roller unit 230B including the pickup roller 231 is moved from the first retracting position to the lowermost position in a state where the guide member 240A is held at the stand-up position, whereby the guide member 240A is located at the second position with respect to the pickup roller 231.

Figure 15C:
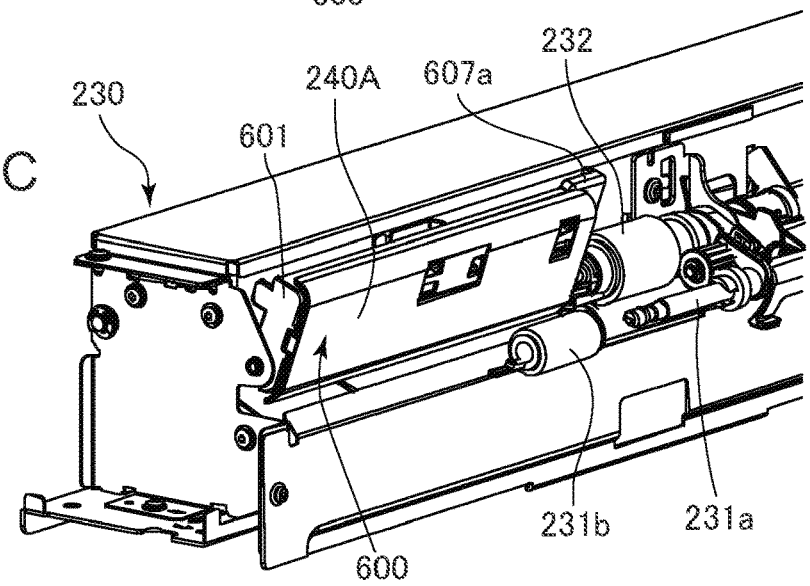
FIG. 15C is a perspective view illustrating a state where a roller part of the pickup roller is pulled out with the pickup roller kept in a state of FIG. 15B.

As described above, the pull-out space for the roller part 231*b* is ensured by locating the guide member 240A at the stand-up position and the roller unit 230B at the lowermost position. Then, as illustrated in FIG. 15C, the roller part 231*b* is manually moved along the rotary shaft 231*a* to pull out the roller part 231*b* from the rotary shaft 231*a*. After the removal of the roller part 231*b*, a new roller part 231*b* is fitted to the rotary shaft 231*a* through the pull-out space. That is, replacement of the roller part 231*b* of the pickup roller 231 is performed in a state where the roller unit 230B and the guide unit 600 are located at the lowermost position and the stand-up position, respectively.

In the present embodiment, the guide unit 600 is held at the stand-up position only by the roller unit 230B, so that the guide unit 600 is manually held when the roller unit 230B is moved to the lowermost position. If the guide unit 600 is inadvertently moved to the guide position, an operator manually moves the guide unit 600 to the stand-up position and hold it.

As described above, the roller unit 230B and the guide unit 600 are configured to turn independently of each other, so that it is possible to easily move the pickup roller 231 or the guide member 240A to a position not overlapping the attachment/detachment (fit/pull-out) direction of the roller part 231*b* of the pickup roller 231, thereby ensuring the pull-out space for the roller part 231*b*. This facilitates replacement of the roller. Further, replacement of the roller is performed in a state where the feeding unit 230A has been withdrawn from the enclosure 204 together with the storage case 210, so that it is possible to endure a wide space for replacement and to further facilitate the replacement operation.

Replacement of Conveying Roller

Figure 16A:
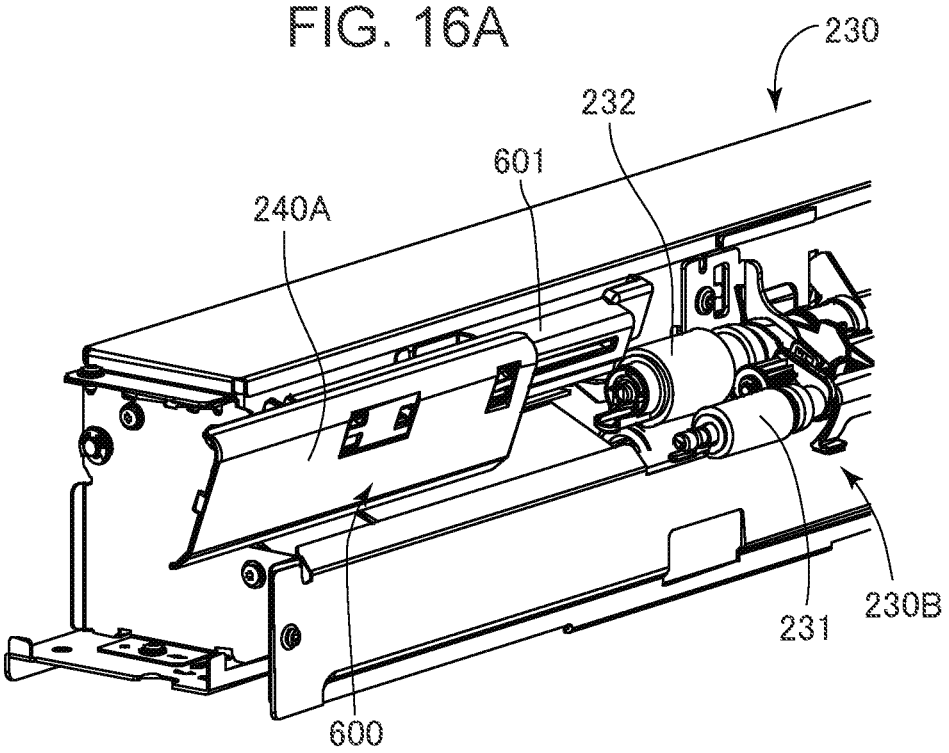
FIG. 16A is a perspective view illustrating a state where a guide member is slid in a state of FIG. 15C.

The following describes replacement of the roller part 232*b* of the conveying roller 232. As described above, when the storage case 210 is withdrawn, the roller unit 230B is located at the first retracting position, and the guide unit 600 is located at the stand-up position (FIG. 15A). Then, the roller unit 230B at the first retracting position is manually moved to the lowermost position with the guide unit 600 held at the stand-up position (FIG. 15B). In this state, as illustrated in FIG. 16A, the guide member 240A is manually slid to the front side with respect to the slide support part 601 to ensure a space for pulling out the roller part 232*b* of the conveying roller 232.

Figure 16B:
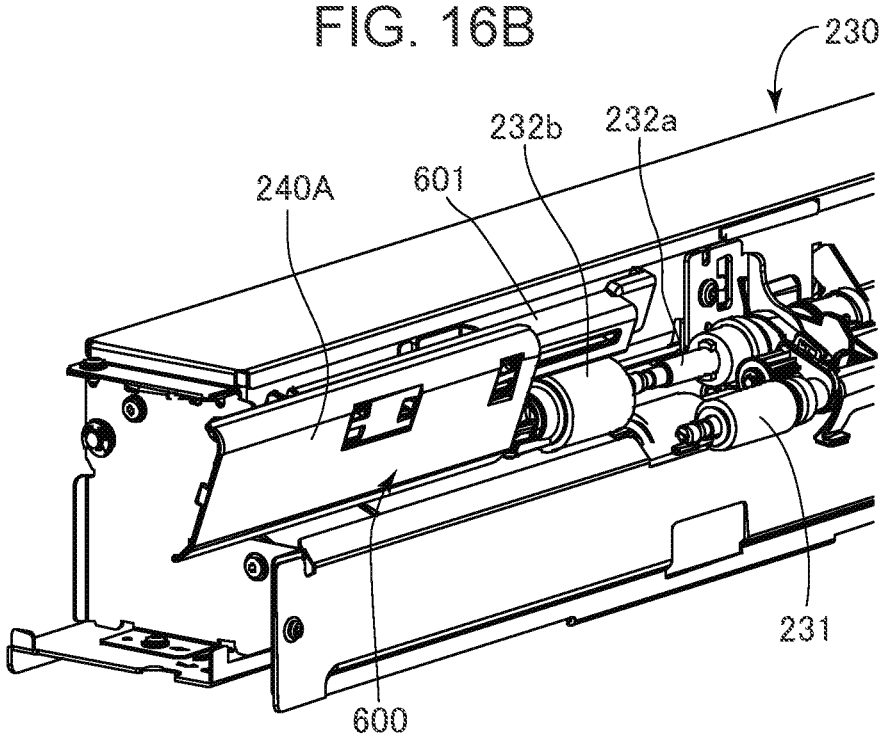
FIG. 16B is a perspective view illustrating a state where a roller part of a conveying roller is pulled out in a state of FIG. 16A.

The pull-out space is thus ensured, and then, as illustrated in FIG. 16B, the roller part 232*b* is manually moved along the rotary shaft 232*a* to pull out the roller part 232*b* from the rotary shaft 232*a*. After the removal of the roller part 232*b*, a new roller part 232*b* is fitted to the rotary shaft 232*a* through the pull-out space. When the guide member 240A is released from the manual holding (when an operator releases his or her hand from the guide member 240A), it is slid to a position adjacent to the conveying roller 232 by the action of the tension spring 604.

Thus, in the present embodiment, the guide member 240A provided in the pull-out direction of the roller part 232*b* is configured to be slidable, and the guide member 240A is slid against the basing force of the tension spring 604 to thereby ensure the attachment/detachment space for the roller part 232*b*, facilitating replacement of the roller. Further, when an operator stops holding the guide member 240A after completion of replacement of the roller, the support plate 240 automatically returns by the biasing force of the tension spring 604, thus preventing an operator from forgetting to return the guide member 240A. Further, replacement of the roller is performed in a state where the feeding unit 230A has been withdrawn from the enclosure 204 together with the storage case 210, so that it is possible to endure a wide space for replacement and to further facilitate the replacement operation.

Other Embodiments

In the above embodiment, the control part 203 for controlling the feeding motor 301 and the solenoid 261 is provided in the multi-stage storage 200; however, the above control may be realized by the control part 140 of the image forming apparatus 100. Further, the sheet feeding apparatus is not limited to the above multi-stage storage, but may be of other configurations, such as a single deck configuration.

Further, in the above embodiment, in a state where the storage case 210 is attached to the enclosure 204, the pickup roller 231 is moved once to the second retracting position from the first retracting position and then to the feed position; in this case, however, the pickup roller 231 may be moved directly from the first retracting position to the feed position when the storage case 210 is attached to the enclosure 204.

Although the feeding unit is configured such that the guide member is turned to vertically relatively move the guide member and the shaft in the above embodiment, the guide member and the shaft may be vertically relatively slid to each other. For example, a moving support part that vertically slidably supports one of the guide member and feeding means with respect to the other one thereof is provided, and the guide member is configured to be slidably movable between the first and second positions with respect to the feeding means. Alternatively, it may be possible to allow the guide member to move between the first and second positions with respect to the feeding means by combining sliding and turning movements.

The vertical slide movement is not limited to the directly vertical movement but may be obliquely vertical movement. Further, the slide movement direction is not limited to the vertical movement. That is, the moving support part that slidably supports one of the guide member and feeding means with respect to the other one thereof may support it in a slidably moving manner in a direction perpendicular to the axial direction of the shaft of the feeding means. Further, as described above, the vertical movement includes the turning movement in addition to the sliding movement.

Further, in the above embodiment, the storage case 210 is withdrawn after the roller unit 230B is made to retract to the first retracting position for subsequent replacement of the pickup roller 231 or conveying roller 232; however, the storage case 210 may be withdrawn without making the roller unit 230B retract for the replacement.

In the above embodiment, to perform replacement of the roller part 231*b* of the pickup roller 231, the guide member 240A is lifted in a state where the pickup roller 231 is in a lowered position to ensure a replacement space for the roller; however, the guide member 240A may be lowered in a state where the pickup roller 231 is in a lifted position to ensure a replacement space.

This application claims priority from Japanese Patent Applications No. 2019-239938 and No. 2019-239939 filed Dec. 27, 2019, and Japanese Patent Applications No. 2020-111857 and No. 2020-111858 filed on Jun. 29, 2020, the entire contents of which are incorporated herein by reference.

What is claimed is:

1. A sheet feeding apparatus for feeding a sheet, comprising:

a storage part that stores a sheet;

a feeding part that has a feeding roller for feeding the sheet stored in the storage part;

an enclosure into and from which the storage part and feeding part are integrally inserted and withdrawn;

a moving mechanism that moves the feeding roller of the feeding part to a feeding position for feeding the sheet and a retracting position for storing the sheet in the storage part, and a detection member that contacts the sheet stored in the storage part to detect presence of the sheet, wherein the moving mechanism moves the feeding roller to the retracting position before the storage part and the feeding part are withdrawn from the enclosure, and moves the feeding roller to the feeding position after the storage part and the feeding part are inserted to the enclosure, and accompanying the movement of the feeding roller to the retracting position, the detection member retracts from a position contacting the sheet stored in the storage part to a position allowing a sheet to be stored in the storage part.

2. The sheet feeding apparatus according to claim 1, wherein the feeding part has a feeding unit integrally including the feeding roller for feeding the sheet, a conveying roller for conveying the sheet fed by the feeding roller, and a first guide member for guiding the upper surface of the sheet fed by the feeding roller, and the moving mechanism turns the feeding unit about a rotary shaft of the conveying roller to move the feeding roller to the retracting position.

3. The sheet feeding apparatus according to claim 2, wherein as viewed in a vertical direction from the retracting position, at least a part of an outer peripheral surface of the feeding roller overlaps the conveying roller.

4. The sheet feeding apparatus according to claim 1, further comprising:

a guide member for guiding an upper surface of the sheet fed by the feeding roller; and a rotary shaft from one end side of which the feeding roller is configured to be pulled out, wherein the guide member moves to a first position adjacent to the feeding roller and a second position retracting from the first position to form a space for pulling out the feeding roller from the rotary shaft thereof.

5. A sheet feeding apparatus for feeding a sheet, comprising:

a storage part that stores a sheet;

a feeding part that has a feeding roller for feeding the sheet stored in the storage part;

a storage case having the storage part and the feeding part;

an enclosure into and from which the storage case is inserted and withdrawn;

a holding part that holds the storage case at an attachment position in the enclosure;

a releasing part that releases hold of the storage case by the holding part;

a detection part that detects that the storage case including the storage part and feeding part has been attached to the attachment position in the enclosure; and a moving part that moves the feeding roller of the feeding part to a feeding position for feeding the sheet and a retracting position allowing the sheet to be stored in the storage part, wherein the releasing part releases hold of the storage case by the holding part after the moving part moves the feeding roller to the retracting position, and the moving part moves the feeding roller to the feeding position based on the detection by the detection part that the storage case has been attached to the attachment position.

6. The sheet feeding apparatus according to claim 5, further comprising a release instruction part that issues to the releasing part an instruction of releasing hold by the holding part, wherein based on the instruction from the release instruction part, the moving part moves the feeding roller to the retracting position, and the releasing part releases hold of the storage case by the holding part after the moving part moves the feeding roller to the retracting position.

* * * * *